US005687789A

United States Patent [19]

Lauener

[11] Patent Number: 5,687,789

[45] Date of Patent: Nov. 18, 1997

[54] CASTER WITH IMPROVED COIL CHANGING SYSTEM

[75] Inventor: Wilhelm F. Lauener, Gerlafingen/SO, Switzerland

[73] Assignee: Larex A.G., Solothurn, Switzerland

[21] Appl. No.: 566,775

[22] Filed: Dec. 28, 1995

[51] Int. Cl.[6] ..... B22D 11/06

[52] U.S. Cl. ..... 164/481; 164/432

[58] Field of Search ..... 164/481, 482, 164/431, 432, 433; 242/538, 538.1, 538.2

[56] References Cited

U.S. PATENT DOCUMENTS 4,785,873 11/1988 Lauener .
4,794,978 1/1989 Lauener .
4,798,315 1/1989 Lauener .
4,964,456 10/1990 Lauener .

FOREIGN PATENT DOCUMENTS 864035 6/1978 Belgium .

*Primary Examiner*—Kuang Y. Lin
*Attorney, Agent, or Firm*—David V. Radack; Eckert Seamans Cherin & Mellott, LLC

[57] ABSTRACT

A caster including at least one belt driving and guiding system for driving and guiding a movable belt through a casting zone where molten metal is cast. The belt driving and guiding system includes a first coil having an axis of rotation, the first coil being positioned relative to the caster such that the first coil can be moved so that its axis of rotation is spaced generally parallel to its axis of rotation before it was moved. The belt driving and guiding system also includes a second coil. In this way, the movable belt can be alternately uncoiled and coiled from the first coil and the second coil without having to dismount either the first or second coil from the caster. An associated method of casting molten metal is also disclosed.

6 Claims, 2 Drawing Sheets

CASTER WITH IMPROVED COIL CHANGING SYSTEM

BACKGROUND OF THE INVENTION

This invention relates to a caster, and more particularly to a caster having an improved coil changing system.

U.S. Pat. No. 4,964,456 discloses a vertical twin belt caster having a pair of movable opposed belts which, along with a pair of opposed movable side dams, define a mold. The mold receives molten metal from a nozzle connected to a tundish. The molten metal is solidified into a metal product and moved out of the mold by the movable belts at casting speed.

The belts are uncoiled from a top coil and are guided through a casting zone including the mold by a pair of vertically spaced pulleys. The belt is then coiled on the lower coil. Once the belt is completely uncoiled from the top coil and coiled onto the bottom coil, the coils are dismounted from the caster, the belt is recoiled from the bottom coil to the top coil by recoiling equipment and the coils are again remounted onto the caster. It will be appreciated that dismounting and recoiling the coils is a somewhat involved process which involves the use of heavy equipment, such as, for example, an overhead crane and recoiling equipment. The process of changing the coils is also fairly time consuming. Of course, during this time, no metal is being cast thus lowering the overall productivity of the caster.

What is needed, therefore, is a caster having a belt driving and guiding system which improves the coil changing operation so that the overall productivity of the caster is improved, while at the same time providing for a high quality continuously cast metal product.

SUMMARY OF THE INVENTION

The caster of the invention has met or exceeded the above as well as other needs. The caster comprises at least one belt driving and guiding system for driving and guiding a movable belt through a casting zone where molten metal is cast. The belt driving and guiding system includes a first coil having an axis of rotation, the first coil being positioned relative to the caster such that the first coil can be moved so that the axis of rotation of the first coil after moving the first coil is spaced parallel to the axis of rotation of the first coil before moving the first coil. The belt driving and guiding system also includes a second coil. In this way, the movable belt can be alternately uncoiled and coiled from the first coil and the second coil without having to dismount either the first or second coil from the caster.

A method of casting molten metal is also disclosed. The method involves providing a caster having at least one belt driving and guiding system for driving and guiding a movable belt through a casting zone where molten metal is cast. The belt driving and guiding system includes a first coil having an axis of rotation, the first coil being positioned relative to the caster and having coiled thereon the movable belt and a second coil. The method then comprises uncoiling the movable belt from the first coil, passing the movable belt through the casting zone and coiling the movable belt on the second coil. During this time, molten metal is cast in the caster. The method then comprises discontinuing casting and then restarting casting by uncoiling the movable belt from the second coil, passing the belt again through the casting zone and then coiling the belt on the first coil. Once again, molten metal is cast in the caster.

BRIEF DESCRIPTION OF THE DRAWINGS

A full understanding of the invention can be gained from the following description of the preferred embodiment when read in conjunction with the accompanying drawings in which.

DETAILED DESCRIPTION

As used herein, the term "metal product" means primarily clad or unclad strip or slab made substantially of one or more metals, including without limitation, aluminum and aluminum alloys and can also include, in a broader sense, clad or unclad bar, foil or rod.

Figure 1:
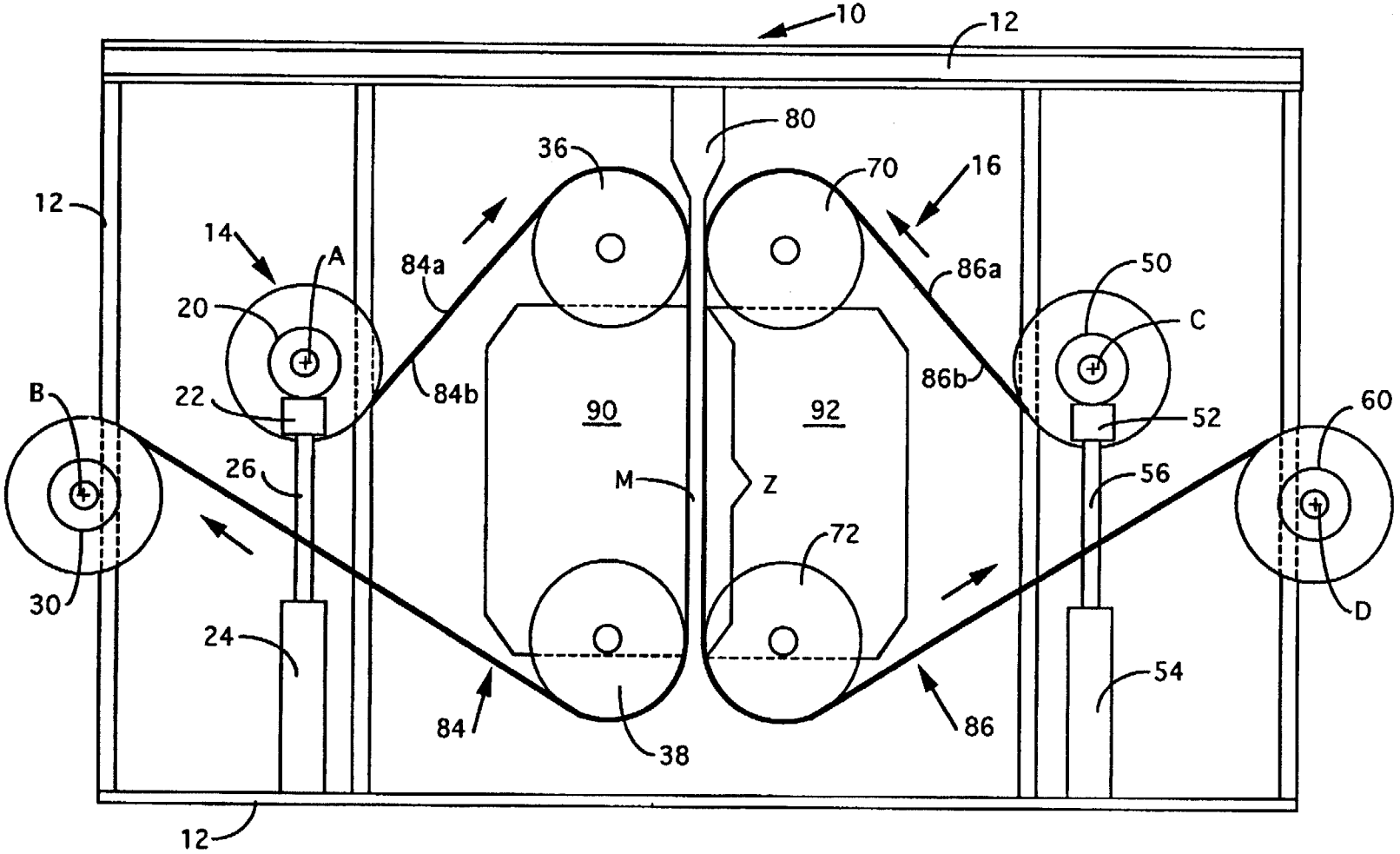
FIG. 1 is a side-elevational view of a vertical twin belt caster showing the first and second belt driving system of the invention.
Figure 2:
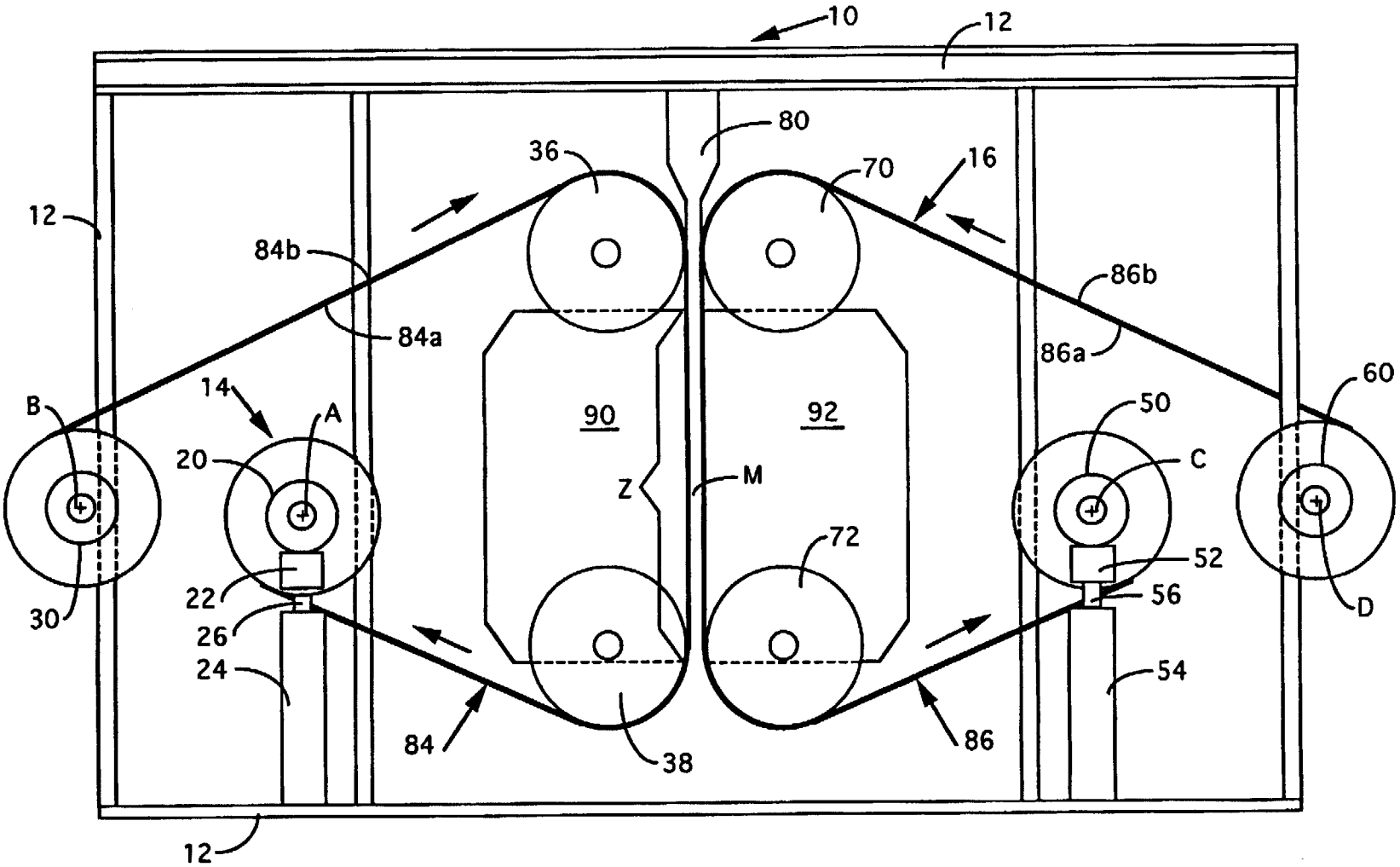
FIG. 2 is a side-elevational view of the vertical twin belt caster of FIG. 1, only showing the coils in an alternate position.

The detailed description of the invention will focus on a vertical twin belt caster shown in FIGS. 1 and 2. It will be appreciated that with some modifications which are well within the ordinary skill of the artisan, the coil changing system can be used for other belt casters, such as a horizontal belt caster that uses an open ended belt. Thus, although the focus of the detailed description will be on the vertical twin belt caster shown in FIGS. 1 and 2, the invention is not so limited and should be given the broadest interpretation of the claims which are appended hereto.

Referring now to FIG. 1, a twin belt caster 10 is shown. The twin belt caster consists of a frame 12 to which are mounted a first belt driving and guiding system 14 and a second belt driving and guiding system 16. The first belt driving and guiding system 14 consists of a first coil 20 mounted on a carriage 22. The first coil 20 has an axis of rotation A about which the first coil 20 is rotatable. The first coil 20 can be moved so that the axis of rotation A of the first coil 20 can be spaced parallel to the axis of rotation A of the first coil 20 before movement of the first coil 20. This can best be seen by comparing the position of axis of rotation A of the first coil 20 in FIG. 1 relative to the position of axis of rotation A of the first coil 20 in FIG. 2.

The movement of first coil 20 relative to the frame 12 of the twin belt caster 10 can be accomplished by any known means. FIGS. 1 and 2 show a hydraulic system consisting of a hydraulic cylinder 24 and a piston 26, the piston 26 being movable vertically with respect to the cylinder 24. The piston 26 is mounted to the carriage 22 holding the first coil 20 in order to move the first coil 20 vertically up and down relative to the frame 12. It will be appreciated that the piston 26 and cylinder 24 are arranged to allow clearance of the belt so that it can be coiled on coil 30.

Referring further to FIG. 1, a second coil 30 having an axis of rotation B is also mounted to the frame 12 of the twin belt caster 10. The second coil 30, unlike the first coil 20, is mounted to the frame 12 so that the second coil 30 and thus the axis of rotation B are fixed. This will be explained in greater detail hereinbelow.

The first belt driving and guiding system 14 finally consists of a pair of pulleys 36 and 38 mounted such that their axes of rotation are in a spaced parallel relationship. These pulleys 36 and 38, which may or may not be driven by drive means, act to guide the belt into the casting zone as will be discussed below.

The second belt driving and guiding system 16 is basically the mirror image of the first belt driving and guiding system 14. The second belt driving and guiding system 16 consists of a third coil 50 mounted on a carriage 52. The third coil 50 has an axis of rotation C about which the third coil 50 is rotatable. The third coil 50 can be moved so that the axis of rotation C of the third coil 50 can be spaced parallel to the axis of rotation C of the third coil 50. This can best be seen by comparing the position of axis of rotation C of the third coil 50 in FIG. 1 relative to the position of axis of rotation C of the third coil 50 in FIG. 2.

The movement of third coil 50 relative to the frame 12 of the twin belt caster 10 can be accomplished by similar means to that shown for first coil 20, although any known means of moving the third coil 50 can be used. FIGS. 1 and 2 show a hydraulic system consisting of a hydraulic cylinder 54 and a piston 56 being movable vertically with respect to the cylinder 54. The piston 56 is mounted to the carriage 52 holding the third coil 50 in order to move the third coil 50 vertically up and down relative to the frame 12. It will be appreciated that the piston 56 and cylinder 54 are arranged to allow clearance of the belt so that it can be coiled on coil 50.

A fourth coil 60 having an axis of rotation D is also mounted to the frame 12 of the twin belt caster 10. The fourth coil 60, unlike the third coil 50, is mounted to the frame 12 so that the fourth coil 60 and thus the axis of rotation D are fixed.

The second belt driving and guiding system 16 finally consists of a pair of pulleys 70 and 72 mounted such that their axes of rotation are in a generally spaced parallel relationship. These pulleys 70 and 72, which may or may not be driven by drive means, act to guide the belt into the casting zone as will be discussed below.

The twin belt caster 10, as is known, is used to continuously cast molten metal into a metal product. Typically, molten metal, such as molten aluminum, is transported from a furnace to a trough and then introduced from the trough into a nozzle. A nozzle 80 is shown in FIGS. 1 and 2, and is positioned between the first belt driving and guiding system 14 and the second belt driving and guiding system 16. A mold M into which the molten metal is introduced is defined by a pair of movable, open ended belts 84 and 86 and a pair of movable opposed side dams (not shown). Belt 84 is driven and guided by belt driving and guiding system 14 and belt 86 is driven and guided by belt driving and guiding system 16. The belts and the side dams form the mold M in a casting zone Z which is shown in FIGS. 1 and 2.

Once the molten metal goes through the nozzle 80 and into the mold M, the movable belts 84 and 86 move the solidified metal product through the casting zone Z. While moving through the casting zone Z, the belts are cooled by coolant water from cooling boxes 90 and 92. This cooling action solidifies the molten metal into the metal product. The metal product is then moved away from casting zone Z for further processing. The further processing may consist of hot rolling the metal product, shearing the metal product or other post-casting processes.

The belts 84 and 86 are thin metal strips, which can be coated or bare, and which are wound and unwound on the coils and over the pulleys to form the mold into which the molten metal is cast. The belts can be any desired width and can have a thickness of between about 0.25 mm to 0.63 or 0.75 mm. As can be seen in FIGS. 1 and 2, the belts have a pair of opposed major surfaces, surfaces **84*a* and 84*b* for belt 84 and surfaces 86*a* and 86*b* for belt 86**.

For more details on the operation of a vertical twin belt caster, see U.S. Pat. No. 4,964,456, the disclosure of which is expressly incorporated by reference herein.

It will be appreciated that, at some point, belts 84 and 86 will become completely unwound from first coil 20 and third coil 50 and onto second coil 30 and fourth coil 60, respectively. In prior art systems this would necessitate removing all of the coils from the frame 12 and recoiling belt 84 from second coil 30 onto first coil 20 and recoiling belt 86 from fourth coil 60 onto third coil 50. This recoiling would have to be done by a separate recoiling machine. After this, the coils would have to be remounted in the caster and the belts 84 and 86 would have to be threaded through the twin belt caster 10 in order to commence casting. It will be appreciated that this is a time consuming exercise which requires separate pieces of equipment (i.e., an overhead crane and a recoiler machine). Furthermore, during this time no molten metal is being cast, thus lowering the productivity of the twin belt caster 10.

Referring now to FIG. 1, the invention provides an apparatus and method of changing the coils which avoids most of the time consuming steps set forth above and not only accomplishes the change without the need for removing the coils from the frame 12 of the twin belt caster 10 but also dispenses with the need for extra equipment, such as an overhead crane and/or a recoiler machine. Once the belts 84 and 86 are fully unwound from first coil 20 and third coil 50, and fully wound onto second coil 30 and fourth coil 60, respectively, both first coil 20 and third coil 50 are simply moved vertically downwardly so that their respective axes of rotation A and C are spaced parallel to the position of their axes A and C before movement. The new position is shown in FIG. 2. The belts 84 and 86 are then threaded through the caster and secured to first coil 20 and third coil 50, and casting can commence immediately. Of course, once the belts 84 and 86 are completely unwound from the second coil 30 and the fourth coil 60, the first coil 20 and third coil 50 are moved again, back to the position shown in FIG. 1, and the process can begin again.

As can be appreciated there is no need to remove the coils from the frame, and no need to use a recoiler machine to recoil the belts from one coil to the other. The coil changing system of the invention accomplishes the change quickly and efficiently and thus increases the overall productivity of the twin belt caster 10.

Another beneficial aspect of the invention is also shown in FIGS. 1 and 2. It will be appreciated that in FIG. 1, one side of belts 84, 86, surfaces **84*a* and 86*a*, are exposed to the molten metal in the mold M while the other side, surfaces 84*b* and 86*b*, are exposed to the coolant from the cooling boxes 90 and 92. In accordance with the invention, the belts can be wound and unwound onto the coils so that the surfaces 84*a*, 86*a* and 84*b*, 86*b* can be alternately exposed to the molten metal. For example, in FIG. 1, surfaces 84*a* and 86*a* are exposed to the molten metal, whereas surfaces 84*b* and 86*b* are exposed to the coolant from the cooling system. The belts 84 and 86 are unwound from first coil 20 and third coil 50 onto second coil 30 and fourth coil 60 so that when first coil 20 and third coil 50 are moved, such as is shown in FIG. 2, surfaces 84*a* and 86*a* are now exposed to the coolant from the cooling system and surfaces 84*b* and 86*b* are exposed to the molten metal in the mold. This is accomplished by unwinding belts 84 and 86 from the bottom of first coil 20 and third coil 50 and then winding the belts 84 and 86 over the top of second coil 30 and fourth coil 60, respectively. This process is reversed in FIG. 2, which shows the belts 84 and 86 being unwound from the bottom of second coil 30 and fourth coil 60 and then being wound onto the top of first coil 20 and third coil 50**, respectively. This not only helps to prolong belt life, but also increases the surface quality of cast metal product by using the surface life of both sides of the belt.

Although the described embodiment includes a coil which is vertically movable, it will be appreciated that the method of the invention is not limited to a movable coil but can be practiced by locating coils or the use of idler rolls which will facilitate coiling and uncoiling the belt such that neither coil needs to be moved.

It will be appreciated that a caster with a unique coil changing system has been disclosed in which removing the coils from the frame and then using recoiling equipment for recoiling the belts are not necessary. The caster with the unique coil changing system improves the productivity of the twin belt caster markedly while at the same time providing a higher quality cast product.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method of casting molten metal comprising:

providing a caster defining a mold, said caster including at least one belt driving and guiding system for driving and guiding a first movable belt through a casting zone where said molten metal is cast, said belt driving and guiding system including (i) a first coil having an axis of rotation, said first coil being positioned relative to said caster and having coiled thereon said first movable belt and (ii) a second coil;

uncoiling said first movable belt from said first coil;

passing said first movable belt through said casting zone;

coiling said first movable belt on said second coil;

introducing said molten metal into said mold; discontinuing casting;

restarting casting by uncoiling said first movable belt from said second coil;

passing said first movable belt through said casting zone;

introducing said molten metal into said mold;

solidifying said molten metal in said mold to create a metal product; and coiling said first movable belt on said first coil, whereby said molten metal can be cast without having to dismount either said first coil or said second coil from said caster.

2. The method of claim 1, including after coiling said first movable belt on said first coil, continuing said method to alternately uncoil and coil said first movable belt.

3. The method of claim 1, including providing a second said belt driving and guiding system for driving and guiding a second said movable belt through said casting zone, said second belt driving and guiding system including (i) a third coil having an axis of rotation, said third coil being positioned relative to said caster and having coiled thereon said second movable belt and (ii) a fourth coil;

uncoiling said second movable belt from said third coil;

passing said second movable belt through said casting zone;

coiling said second movable belt on said fourth coil;

subsequently moving said third coil so that said axis of rotation of said third coil is spaced generally parallel from said axis of rotation of said third coil before moving said third coil;

uncoiling said second movable belt from said fourth coil;

passing said second movable belt through said casting zone; and coiling said second movable belt on said third coil, whereby said molten metal can be cast without having to dismount either said third coil or said fourth coil from said caster.

4. The method of claim 1, including providing said first movable belt having a first major side and an opposed second major side;

uncoiling said first movable belt from said first coil so that said first major side is in contact with said molten metal for at least a portion of the passage of said first movable belt through said casting zone; and coiling said first movable belt on said second coil such that when said first movable belt is next uncoiled from said second coil, said second major side is in contact with said molten metal for at least a portion of the passage of said first movable belt through said casting zone.

5. The method of claim 3, including providing said second movable belt having a third major side and an opposed fourth major side;

uncoiling said second movable belt from said third coil so that said third major side is in contact with said molten metal for at least a portion of the passage of said second movable belt through said casting zone; and coiling said second movable belt on said fourth coil such that when said second movable belt is next uncoiled from said fourth coil, said fourth major side is in contact with said molten metal for at least a portion of the passage of said second movable belt through said casting zone.

6. The method of claim 1, including continuously casting molten aluminum in said caster.

* * * * *